US009974350B2

(12) United States Patent
Perusse et al.

(10) Patent No.: US 9,974,350 B2
(45) **Date of Patent: *May 22, 2018**

(54) HARD HAT

(71) Applicant: Poma 22 LLC, Mendota Heights, MN (US)

(72) Inventors: Steve Harvey Perusse, Mendota Heights, MN (US); Steve Harrington, Carlsbad, CA (US); Joy Salvatin Lee, Carlsbad, CA (US); Bill Campbell, Carlsbad, CA (US); Judy Emaus, Carlsbad, CA (US); Joshua Lee, Mendota, MN (US); Bryan Brutlag, Minneapolis, MN (US)

(73) Assignee: Poma 22 LLC, Mendota Heights, MN (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/369,205

(22) Filed: Dec. 5, 2016

(65) Prior Publication Data

US 2017/0079365 A1 Mar. 23, 2017

Related U.S. Application Data

(63) Continuation of application No. 14/551,854, filed on Nov. 24, 2014, now Pat. No. 9,510,632.
(Continued)

(51) Int. Cl.
*A42B 3/28* (2006.01)
*A62B 18/04* (2006.01)
(Continued)

(52) U.S. Cl.
CPC ..... *A42B 3/286* (2013.01); *A42B 3/145* (2013.01); *A62B 18/003* (2013.01); *A62B 18/045* (2013.01)

(58) Field of Classification Search
CPC ..... A42B 3/286; A42B 3/288; A42B 3/281; A62B 18/045
See application file for complete search history.

(56) References Cited

U.S. PATENT DOCUMENTS 2,032,101 A 2/1936 Sullivan
2,333,054 A 10/1943 Sullivan
(Continued)

FOREIGN PATENT DOCUMENTS

DE 3306691 9/1984
DE 3306692 9/1984

OTHER PUBLICATIONS

Jan. 11, 2016 PCT Preliminary Examination Report (Serial No. PCT/US14/67157)—Our Matter 5214.
(Continued)

*Primary Examiner* — Bobby Muromoto, Jr.
(74) *Attorney, Agent, or Firm* — Tysver Beck Evans, PLLC

(57) ABSTRACT

One or more battery-operated fans are integrated into a hard hat and pull air through a filter to remove contaminants in the air. The filtered air passes through one or more channels in the hard hat and exits the hard hat through an air curtain exit located near the user's face. The exiting air leaves with sufficient velocity to form an air curtain. A user wearing goggles or other protective eyewear will have the filtered air current pass in front of the eyewear. Paint and other contaminant particles that are in the air will not be able to contact the outer surface of the eyewear, as the particles will not be able to pass through the curtain of filtered air.

8 Claims, 18 Drawing Sheets

Related U.S. Application Data

(60) Provisional application No. 61/963,050, filed on Nov. 22, 2013, provisional application No. 61/997,916, filed on Jun. 13, 2014.

(51) Int. Cl.
*A42B 3/14* (2006.01)
*A62B 18/00* (2006.01)

(56) References Cited

U.S. PATENT DOCUMENTS

| | | | | |
|---|---|---|---|---|
| 2,688,962 | A | 9/1954 | Summers | |
| 3,813,696 | A * | 6/1974 | Yeager | A42B 3/286 2/171.3 |
| 3,881,478 | A | 5/1975 | Rosendahl et al. | |
| 3,925,821 | A | 12/1975 | Lewicki | |
| 4,227,520 | A | 10/1980 | Lord | |
| 4,803,979 | A | 2/1989 | Fischer | |
| 5,050,240 | A * | 9/1991 | Sayre | A42B 3/122 137/38 |
| 5,283,914 | A | 2/1994 | James | |
| 5,577,495 | A | 11/1996 | Murphy | |
| 5,592,936 | A | 1/1997 | Thomas et al. | |
| 6,081,929 | A | 7/2000 | Rothrock et al. | |
| 6,513,168 | B2 | 2/2003 | Paris et al. | |
| 6,810,532 | B2 * | 11/2004 | Wang Lee | A42B 3/281 128/200.28 |
| 6,904,616 | B1 | 6/2005 | Maki et al. | |
| 6,973,676 | B1 * | 12/2005 | Simpson | A42B 3/288 128/201.24 |
| 6,990,691 | B2 | 1/2006 | Klotz et al. | |
| 7,036,502 | B2 | 5/2006 | Manne | |
| 7,114,194 | B2 * | 10/2006 | English | A42B 3/286 2/171.3 |
| 8,590,062 | B2 | 11/2013 | Gupta | |
| 2003/0182711 | A1 | 10/2003 | Klotz et al. | |
| 2005/0114986 | A1 | 6/2005 | Hobart | |
| 2006/0053528 | A1 | 3/2006 | English | |
| 2007/0044800 | A1 * | 3/2007 | Church | A42B 3/288 128/205.29 |
| 2007/0089221 | A1 | 4/2007 | Manzella, Jr. et al. | |
| 2007/0094768 | A1 | 5/2007 | Moudgill | |
| 2007/0094769 | A1 | 5/2007 | Lakes et al. | |
| 2009/0055987 | A1 | 3/2009 | Becker et al. | |
| 2009/0210989 | A1 * | 8/2009 | Becker | A61F 9/068 2/8.6 |
| 2009/0250060 | A1 | 10/2009 | Hacke et al. | |
| 2010/0294270 | A1 | 11/2010 | Curran et al. | |
| 2012/0167282 | A1 | 7/2012 | Fleming et al. | |
| 2013/0263364 | A1 | 10/2013 | Green | |
| 2014/0026300 | A1 * | 1/2014 | Silveira | A61F 9/068 2/431 |

OTHER PUBLICATIONS

Oct. 23, 2015 PCT Preliminary Examination Report (Serial No. PCT/US14/67157)—Our Matter 5214.

Jun. 3, 2015 PCT Search Report (Serial No. PCT/US14/67157)—Our Matter 5214.

3M Respiratory Products, http://www.westernsafety.com/3m/3mrespiratorypg4.html, p. 1-17, May 21, 2013.

Jun. 23, 2016 USPTO Office Action (U.S. Appl. No. 14/551,854)—Our Matter 5210.

* cited by examiner

HARD HAT

RELATED APPLICATIONS

The present application claims the benefit of U.S. patent application Ser. No. 14/551,854, filed on Nov. 24, 2014, which in turn claims the benefit of U.S. Provisional Patent Application Ser. No. 61/963,050, filed on Nov. 22, 2013, as well as U.S. Provisional Patent Application Ser. No. 61/997,916, filed on Jun. 13, 2014, all of which are incorporated herein by reference.

FIELD OF THE INVENTION

The present application relates to the field of hard hats used in the construction and painting industries. More particularly, the application relates to a hard hat with an integrated fan system that provides filtered air flowing over a user's face to keep eyewear relatively free of paint and dirt contaminants.

SUMMARY

In one embodiment of the present invention, battery operated fans are integrated into a hard hat. The fans pull air through a filter, thereby removing contaminants in the air. The filtered air passes through one or more channels integrated into the hard hat and then exits the hard hat through a wide air-exit portal proximal to the user's face. The exiting air leaves the exit portals with sufficient velocity to form an air curtain. A user wearing goggles or other protective eyewear will have the filtered air current pass in front of the eyewear. Paint and other contaminant particles that are in the air will not be able to contact the outer surface of the eyewear, as the particles will not be able to pass through the curtain of filtered air.

DETAILED DESCRIPTION

Hard Hat 100

Figure 1:
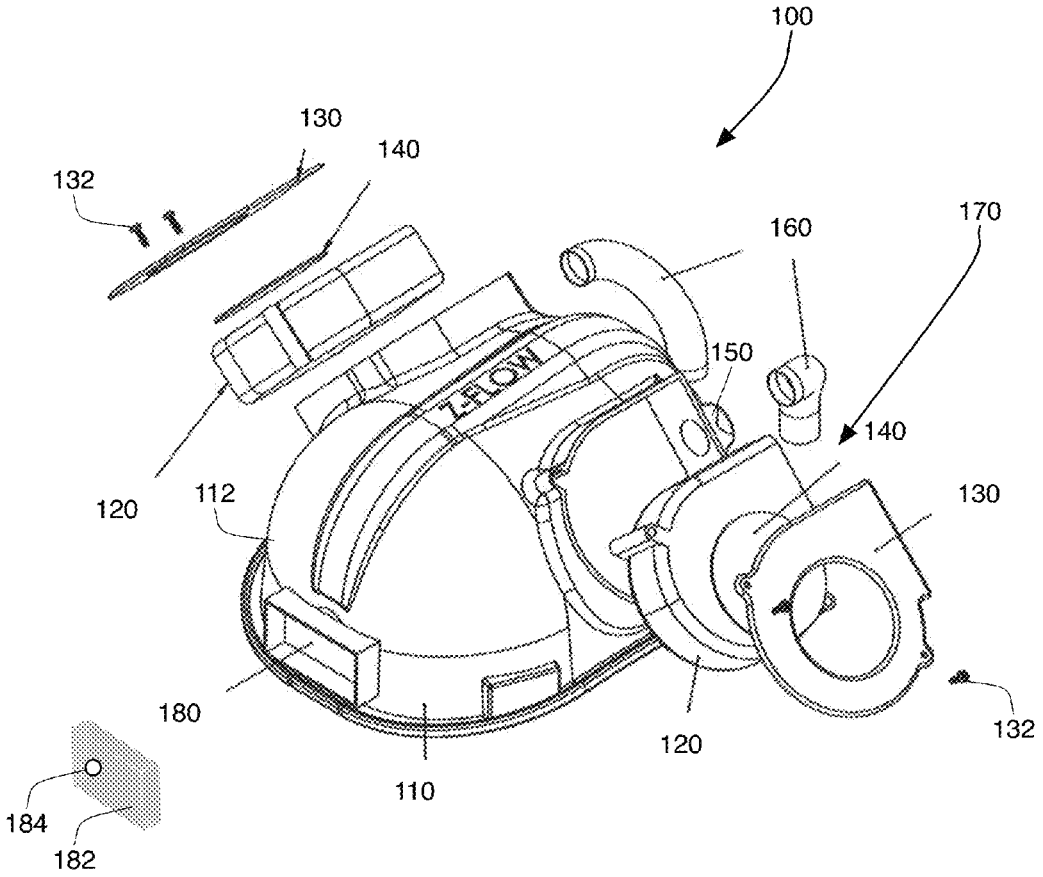
FIG. 1 is an exploded, isometric view of a first embodiment of the present invention.

FIGS. 1 through 4 shows a first embodiment of a hard hat or helmet 100 that incorporates the present invention. The hard hat 100 includes a main body portion 110. The main body portion 110 serves the purpose of protecting the user's head as well as a mounting body for a plurality of electrical and air flow components. This body portion 110 may be made of a multitude of thermoplastic materials such as ABS, Polycarbonate, or other blends. Additionally, depending on the protection requirements, the helmet body 110 may be made of carbon fiber for increased strength and decreased weight.

Mounted on the helmet body 110 are one or more blower fans 120. In the embodiment shown in FIGS. 1 through 4, two radial flow blower fans 120 are located on the helmet body 110, one on the left side of the helmet body 110 and one on the right. The radial blower fans 120 are mounted on the helmet body 110 via mounting plates 130 and screw fasteners 132. The mounting plates 130 also position and hold in place the filter pads 140. The filter pads 140 cover the air intake of the blower fans 120 so that debris in the surrounding environment does not enter. During use in a dirty environment, the air may be filled with a variety of particulate matter, such a dry-wall dust or floating paint particles. Air that is pulled into the intakes of the blower fans 120 must pass through these filter pads 140, which will extract these particulates from the air. The filter pads 140 can be made of a variety of materials, including Tyvek, open-cell foam, and other materials known in the prior art. Additionally, these filter pads can be replaced with larger air filter mechanisms depending on the user's environment.

The air exits the radial blower fans 120 through holes 150 in the mounting bosses on the main helmet body 110. These holes 150 are connected to tubes 160 that direct the airflow down into the "air curtain exit" 170. The tubes 160 shown in FIG. 1 are merely an exemplary embodiment. In other embodiments, air channels can be incorporated into the main helmet body 110 to receive the air exiting the blower fans 120 and direct the air to the air curtain exit 170.

A mounting boss 180 is mounted to the rear end 112 of the main helmet body 110. The mounting boss 180 provides a mounting for the other electrical components of helmet 100. In the preferred embodiment, the mounting boss 180 would hold a removable battery element 182 that contains a battery pack, an on/off switch, and a throttling control 184. The mounting boss 180 has electrical connectors that connect to connectors on the battery element 182. The electrical connectors on the mounting boss 180 lead to power lines (not shown) integrated into the main helmet body 110 that direct power from the battery element 182 to the blower fans 120. The battery pack supplies the electrical power needed by the blower fans 120. In the preferred embodiment, the battery pack in the battery element 182 either uses standard-sized replaceable batteries, or contains rechargeable batteries. The throttling control 184 controls the speed of the blower fans 120, thereby increasing or decreasing the airflow through the air curtain exit 170.

Figure 2:
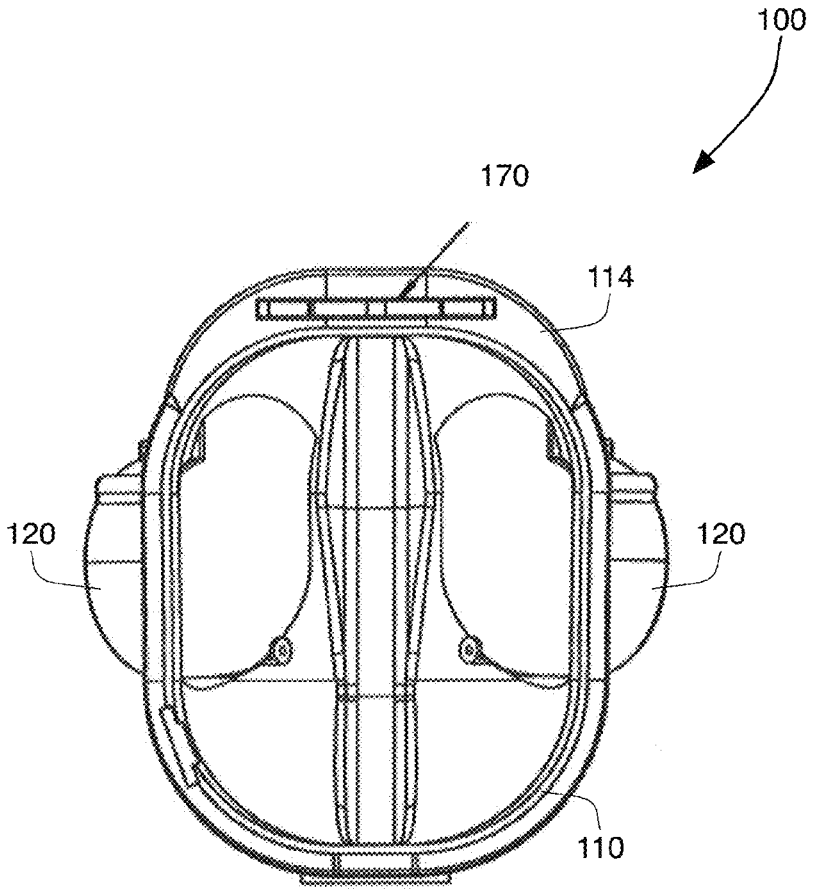
FIG. 2 is a bottom plan view of the first embodiment.
Figure 3:
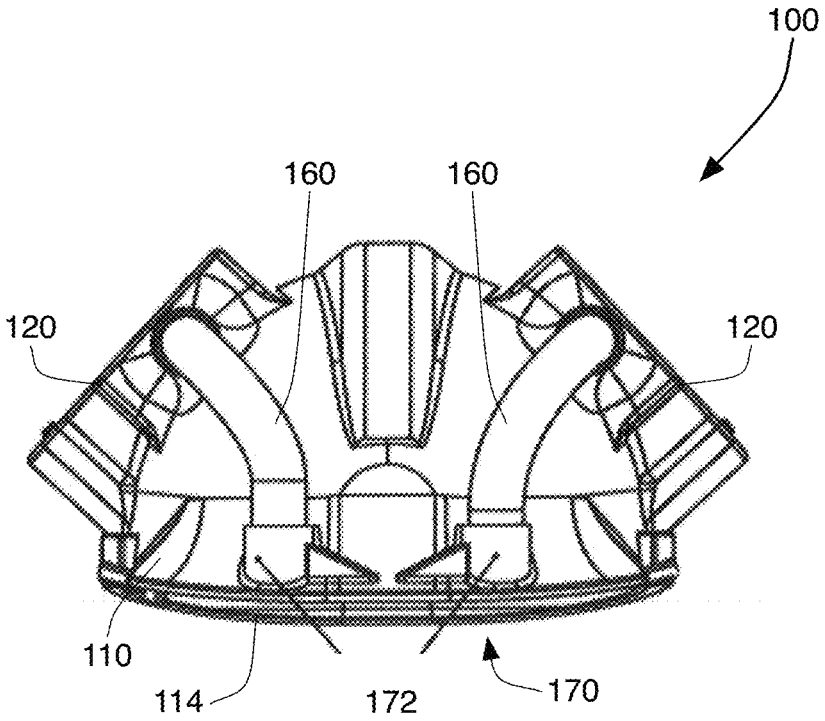
FIG. 3 is a front plan view of the first embodiment.
Figure 4:
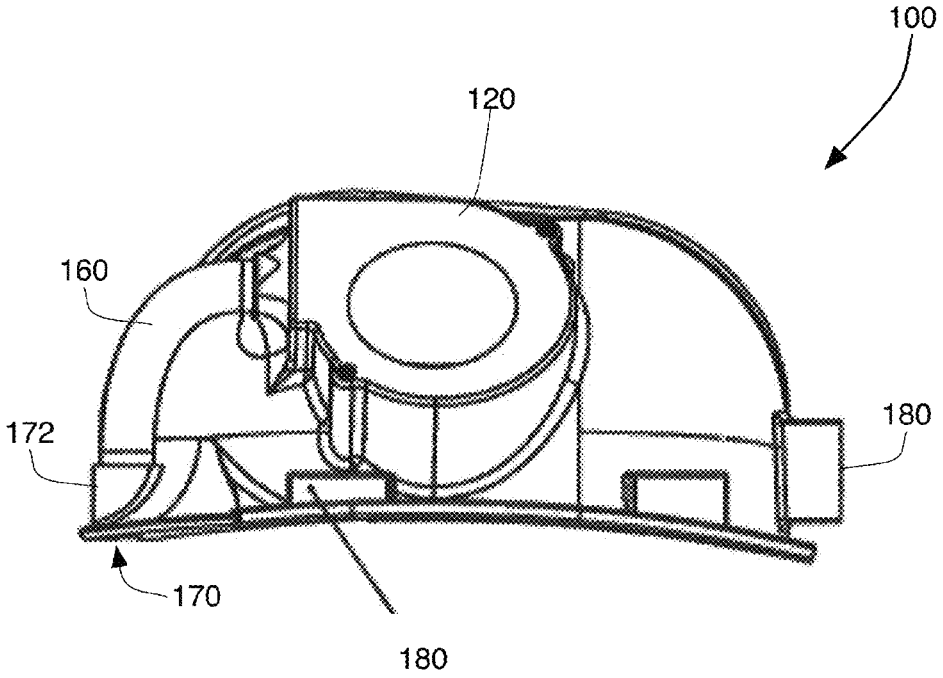
FIG. 4 is a left side view of the first embodiment.

FIGS. 2, 3, and 4 show additional details about the air curtain exit 170. The airflow from the blower fans 120 is directed through the tubes 160 and out through the air curtain exit 170, which in FIG. 2 is shown to be an elongated slot directed downward from the front brim 114 of the main helmet body 110. The air from the blower fans 120 exits the slot 170 at a high flow rate that is directed downward from the front brim 114. The air is spread out through the entire slot of the air curtain exit 170, thereby creating a curtain of air that directs any air-borne debris in the environment downward and away from the user's face. This debris includes paint particles, dust, as well as other debris typically encountered in a construction environment. The geometry of this air curtain exit 170 is not limited to a continuous slot, as a plurality of holes, slots, and vents can be combined to create the desire effect. The air curtain exit 170 should be thin enough so as to create a strong current of air. There must be sufficient air velocity out of the air curtain exit 170 as to push most airborne particles away from the face of the user even in the presence of a modest wind. Preferably, the air velocity is sufficient to create an air current that extends 4-5 inches below the air curtain exit 170. A three-inch air current is, however, sufficient to provide some protection to the eyes of the user.

In order to spread the airflow from the fans 120 through the entire width of the air curtain exit 170, the air tubes 160 are connected to the exit slot 170 through a connecting boss 172. These bosses 172 are integrated into the main helmet body 110 and serve the dual-purpose of connecting the tubes 120 as well as dispersing the airflow throughout the width of the air curtain exit 170. The triangular shape of the bosses 172 shown in FIG. 3 are representative of a type of geometry that can disperse the airflow as it exits the tubing 120.

FIG. 4 also shows a connecting boss 180 for a helmet suspension. A helmet suspension is an adjustable web of material, typically a flexible plastic, that comfortably holds the helmet 100 on the head and provides additional protection to the head in case of an impact against the helmet 100. The geometry for the helmet suspension boss 180 shown in FIG. 4 is similar to helmet suspension bosses found on prior art hard hats, meaning that after-market helmet suspensions from different manufacturers can be used with helmet 100.

Hard Hat 400

A second embodiment 500 for a hard hat or helmet that incorporates the present invention is shown in FIGS. 5 through 12. This helmet 500 again utilizes a main body 510 to house electrical and air-flow components as well as to protect the user from falling debris and impacts. The helmet body 510 may be constructed of the same types of materials described above in connection with the first embodiment 100. The helmet 500 is designed to be worn on the human head, and utilizes a clip 580 within the main helmet body 510 for mounting helmet suspension system that can adjust to the size of each user's head. This clip 580 is compatible with the clipping mechanisms that are typically used in after-market helmet suspension systems.

As was the case with helmet 100, helmet 500 incorporates one or more blower fans 520 to move air through the helmet and out an air curtain exit 530 located at the front 512 of the helmet body 510. In the embodiment 500 shown in FIGS. 5-12, four fans 520 are mounted on the exterior of the helmet body 510. These blower fans are powered by a battery pack system and controlled by an on-off switch and a throttling control, as was described above in connection with helmet 100.

Each of the blower fans 520 is covered by an air filter 540. The air filter 540 can be constructed using standard filtration materials and layers. The filters 540 used in connection with helmet 500 can take the form of filter cartridges that are mounted external to the blower fans 520. These filter cartridges 540 can attach onto the main helmet body through a mating feature that creates a non-permanent means of attaching the filter cartridges 540 to the helmet 500. This mating feature can be accomplished through a male and female threading feature. Existing air filter cartridges use a standard thread, so a similar thread feature could be used in helmet 500 to allow the use of existing, standard filter cartridges. Alternatively, the filter cartridge 540 could be held in place through snap fit feature. One technique for a snap fit mounting is to construct a cylindrical opening portion 1200 above each blower fan 520, with this cylindrical portion 1200 having a ridge 1210 at its periphery (shown schematically in FIG. 12). The filter cartridge 540 would have an opening with an elastic (rubber or plastic) rim, which would stretch over and be held in place by the ridge 1210. A plurality of filter cartridges, may be used, each having different filtration, air flow, weight, and balance characteristics, which would allow a user to select the air filter that is appropriate for the work to be performed.

Figure 5:
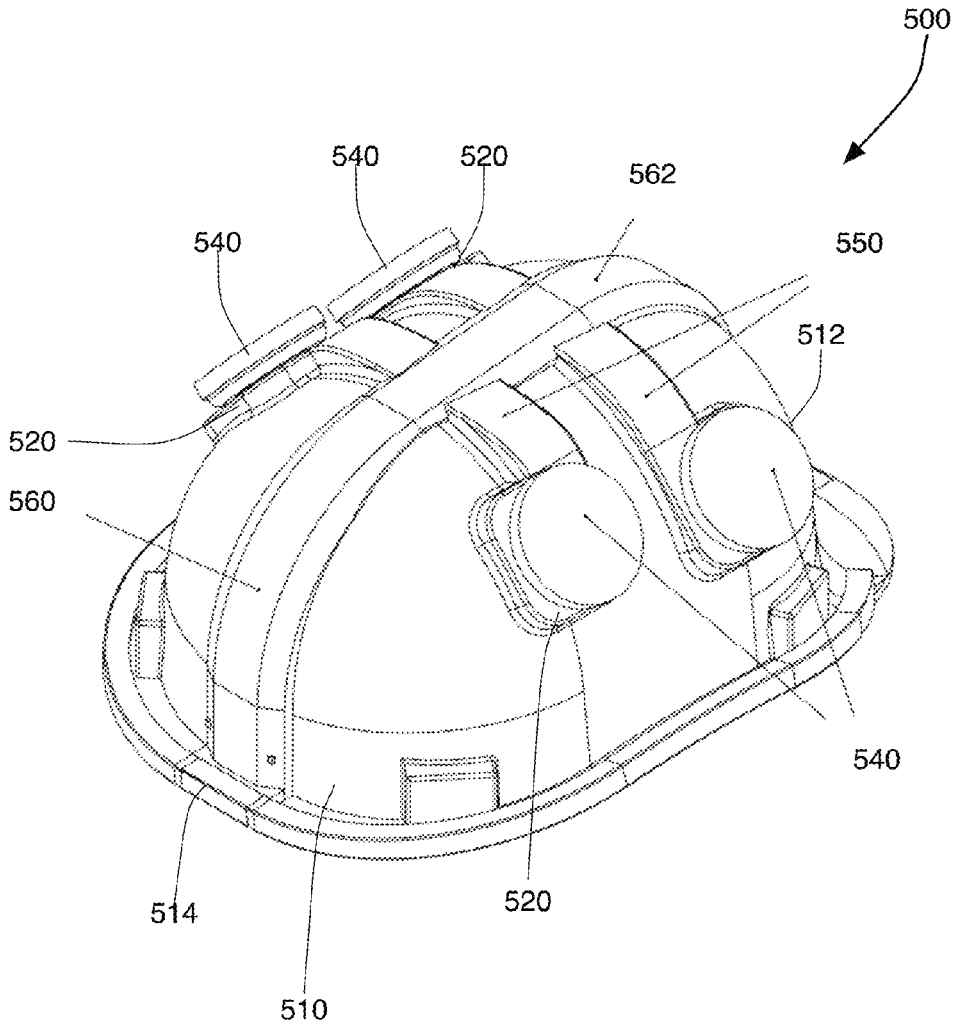
FIG. 5 is an isometric view of a second embodiment of the invention.
Figure 6:
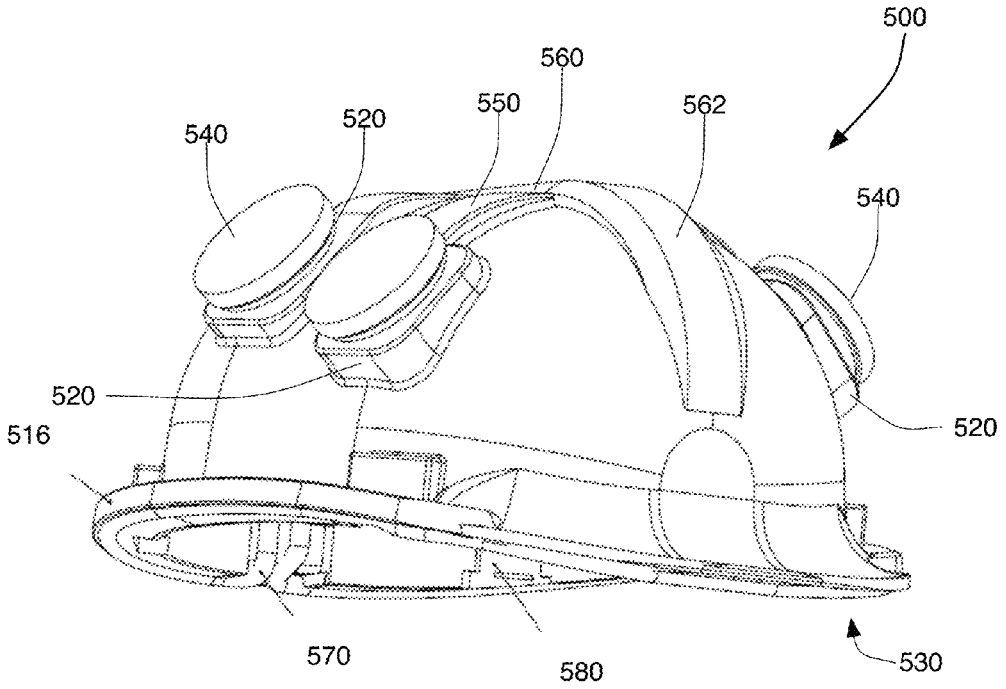
FIG. 6 is a front angle view of the second embodiment that shows the internal tubing.

Blowers 520 pull air from the external environment through filters 540. This filtered air then passes through the fan 520 and enters one of the side flow channels 550. In the embodiment shown in the figures, each of the separate fans 520 has its own side flow channel 550. Each side flow channel 550 is connected at the center of the helmet 500 to a center or main flow channel 560. The power of the blower fans 520 increases the air pressure inside the side flow channels 550, thereby forcing the filtered air into the main flow channel 560. The main flow channel 560 then directs the pressurized, filtered air toward the rear 514 of the main body 510 of helmet 500. Note that FIG. 5 shows an external ridge 562 matching the main flow channel 560 extending toward the front 512 of the helmet. In the preferred embodiment, this is a decorative ridge and does not provide a passage for air flow.

Figure 7:
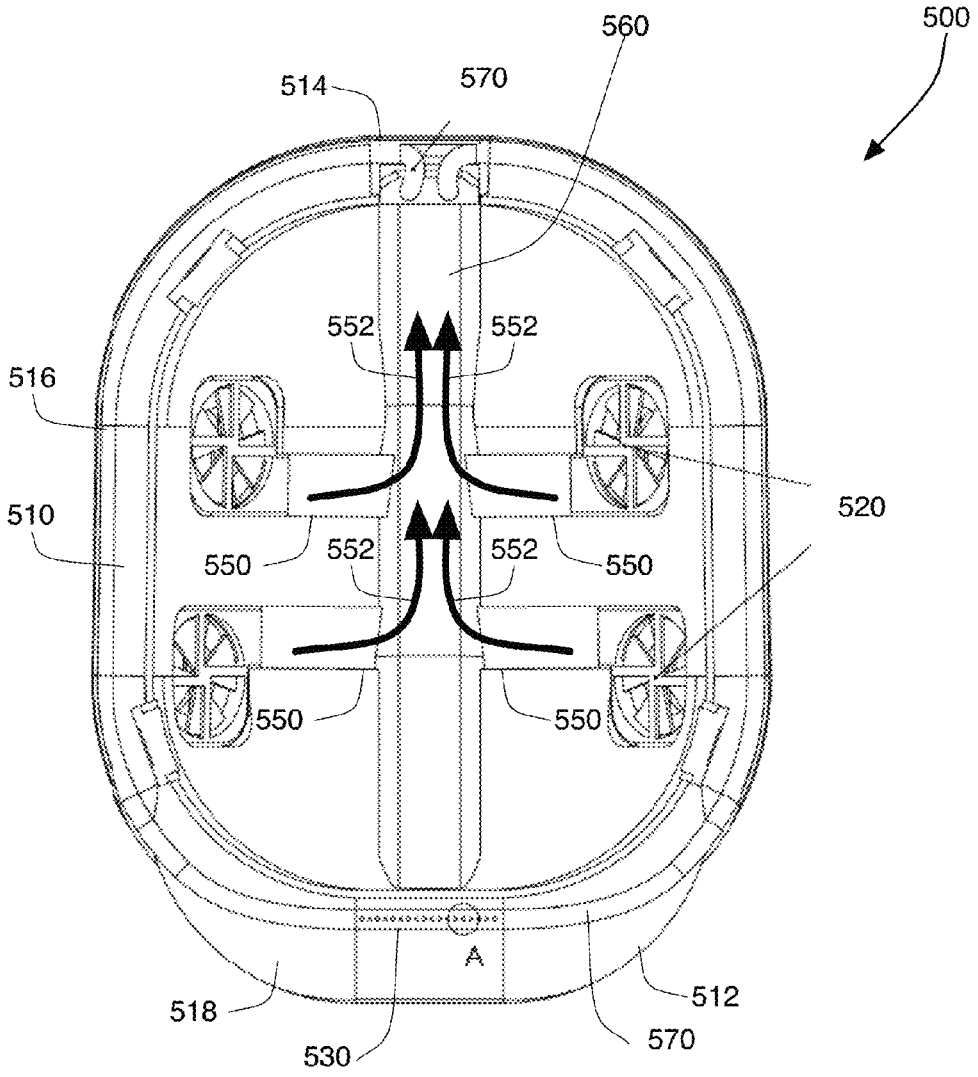
FIG. 7 is a bottom view of the second embodiment.

This movement of air from the blowers through the side flow channels 550 and into the main flow channel 560 is represented by arrows 552 shown in FIG. 7. The side flow channels 550 and the main flow channel 560 are formed integrally into the main body 510 of the helmet 500. For example, the helmet 500 could be formed through an injection molding process using thermoplastics or thermosetting polymers, in which the mold forms the channels 550, 560 in the helmet 500. Alternatively, the channels 550, 560 could be partially formed with the rest of the helmet body 510 and be left open through the top or bottom of the body 510. A plate (not shown in the Figures) could then close and seal the blowers 520 and flow channels 550, 560 to form an air-tight seal. This plate may be fastened via screws and a gasket, adhesive, ultrasonic welding, or through alternative means that create a sufficient seal. FIG. 7 shows a bottom view of helmet 500 with a bottom plate having been removed. A third alternative is to form the helmet body 510 and channels using a 3-D printing process.

Figure 10:
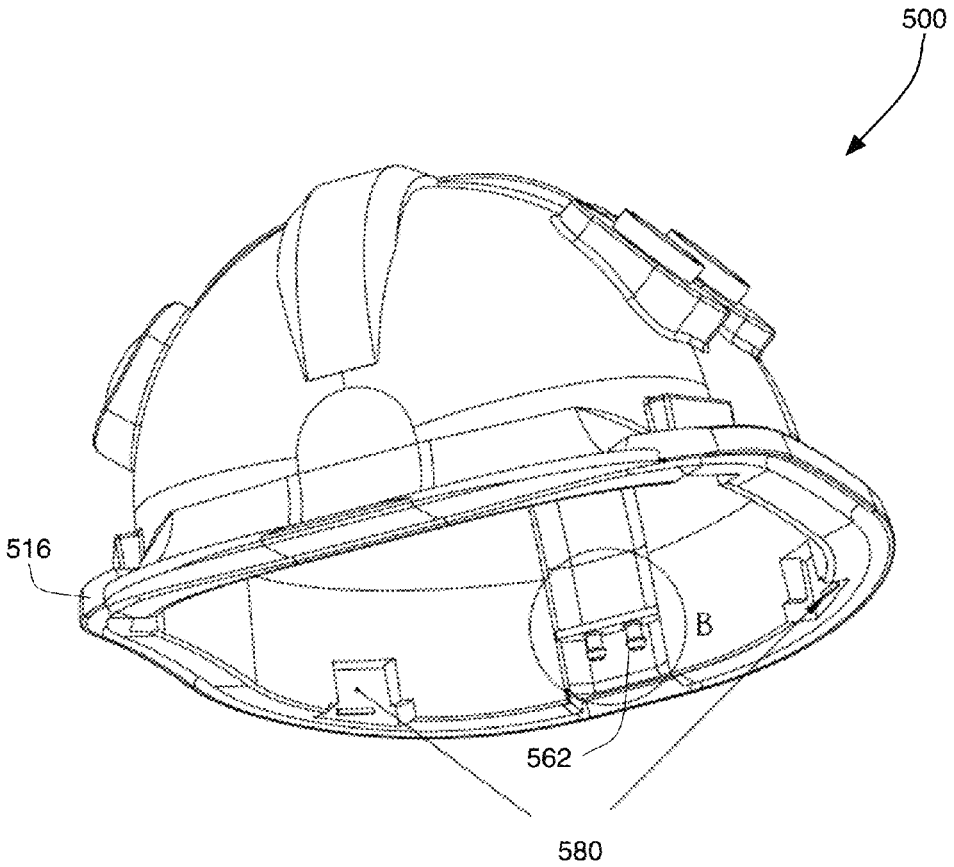
FIG. 10 is a bottom angle view of the second embodiment.
Figure 11:
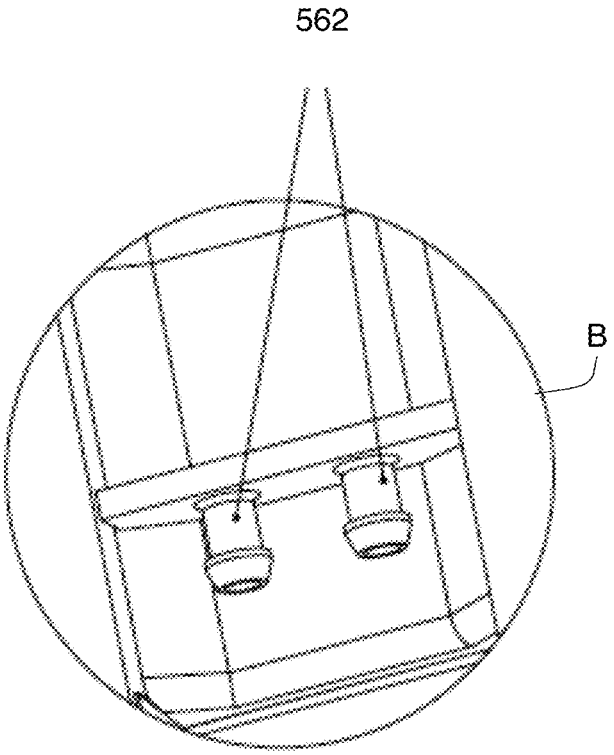
FIG. 11 is a detailed view of part B of FIG. 10.
Figure 12:
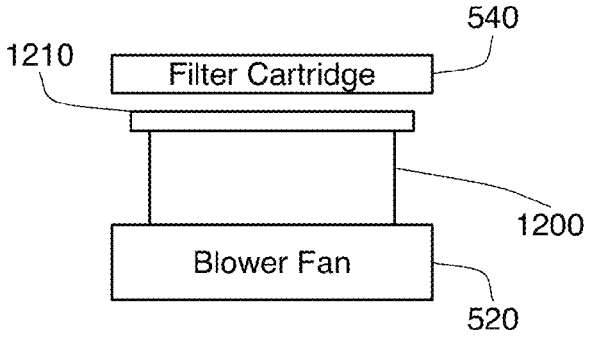
FIG. 12 is a schematic view of an attachment means for a blower fan and a filter cartridge.

At the rear 514 of the helmet body 510, the main flow channel 560 terminates at one or more tubing connection elements or nipples 562, as is best seen in FIGS. 10 and 11. Connected to these connection elements 562 is air curtain tubing 570, which is preferably made from a flexible plastic but can also be formed from rubber. The air curtain tubing 570 forms a loop with two termination points 572 that connect to the two connection elements 562. This brings the interior of the air curtain tubing 570 into fluid connection with the main flow channel 560. The air curtain tubing 570 wraps around the perimeter rim 516 of the main helmet body 510. The tubing 570 is held with the rim 516 via a snap-fit feature that runs around the entire perimeter 516 of the helmet 500. The snap-fit feature can be formed by creating a channel in the rim 516 that is large enough to receive the width of the tubing 570. Occasional ridges or protrusions at the entry of the channel will keep the tubing 570 in position within the channel, while still allowing the flexible tubing 570 to be pulled out of the channel when desired. The tubing 570 can also be easily removed and reattached to the nipples 562, which allows for user replacement of the tubing 570 in the field. The ability for a user to remove the tubing 570 is beneficial, as it is anticipated that the tubing 570 may require cleaning or replacement since no filter can remove 100% of the particulates, and particulates can therefore gather within the tubing and cause clogging issues.

Figure 8:
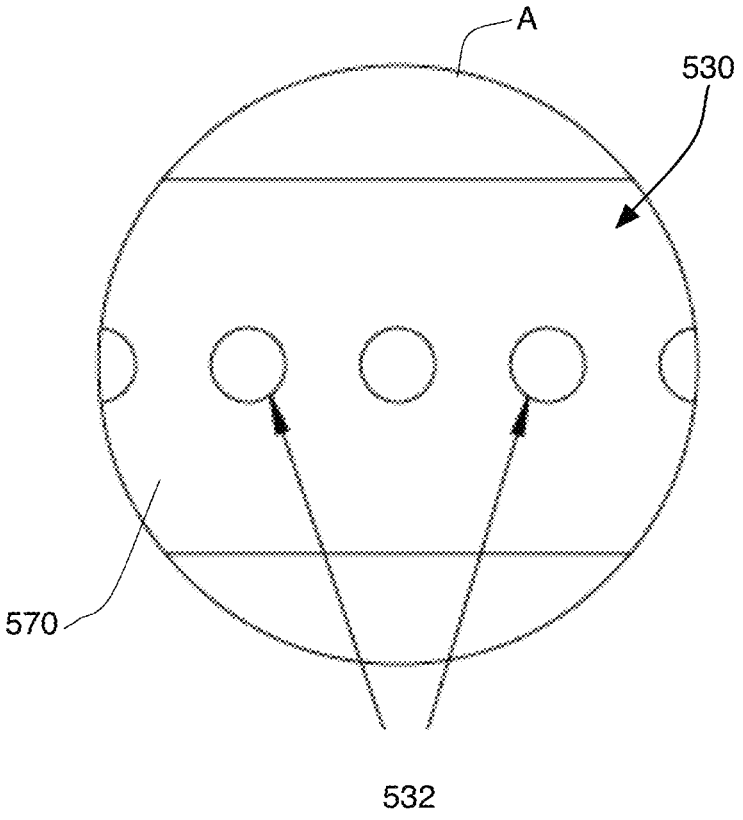
FIG. 8 is a detailed view of part A of FIG. 7.
Figure 9:
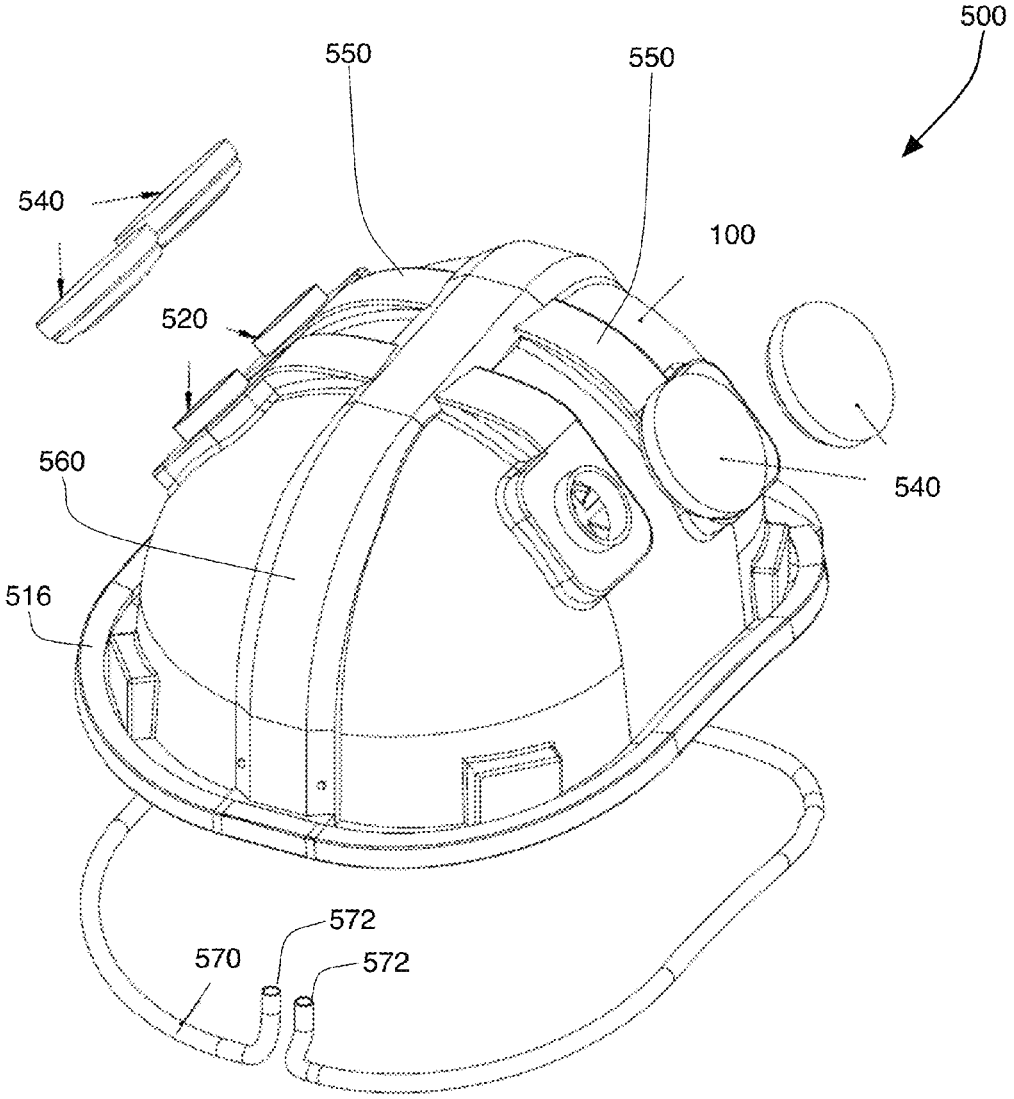
FIG. 9 is an exploded, isometric view of the second embodiment.

FIGS. 7 and 8 shows that the air curtain tubing 570 wraps around from the rear 514 of the helmet body 510 to the front 512. At the front 512 side of the helmet 500 is a brim 518, and underneath this brim an air curtain exit 530 is formed in the tubing 570. As shown in FIG. 8, the air curtain exit 530 can take the form of a plurality of holes 532 or slits that are formed directly into the tubing 570. Although holes are depicted in FIG. 8, slots, perforations, or other openings in the tubing 570, or a combination of the aforementioned, may be used to achieve the given air curtain effect. These openings 532 face downward from the brim 518, and direct the filtered air downward at a flow rate sufficient to form an air current of sufficient strength so as to eliminate any ambient particulate from getting to the user's face.

In use, the blower fans 520 pull in the ambient air through the filters 540 and the push the filtered air into the side flow channels 550 into the main flow channel 560. The air then flows through the connection nipples 562 into the air curtain tubing 570. The air then flows through the tubing 570 and out the air curtain exit 530, which forms the air current that blows airborne particulates away from a users face and away from the user's protective eye wear.

Hard Hat 1300

Figure 13:
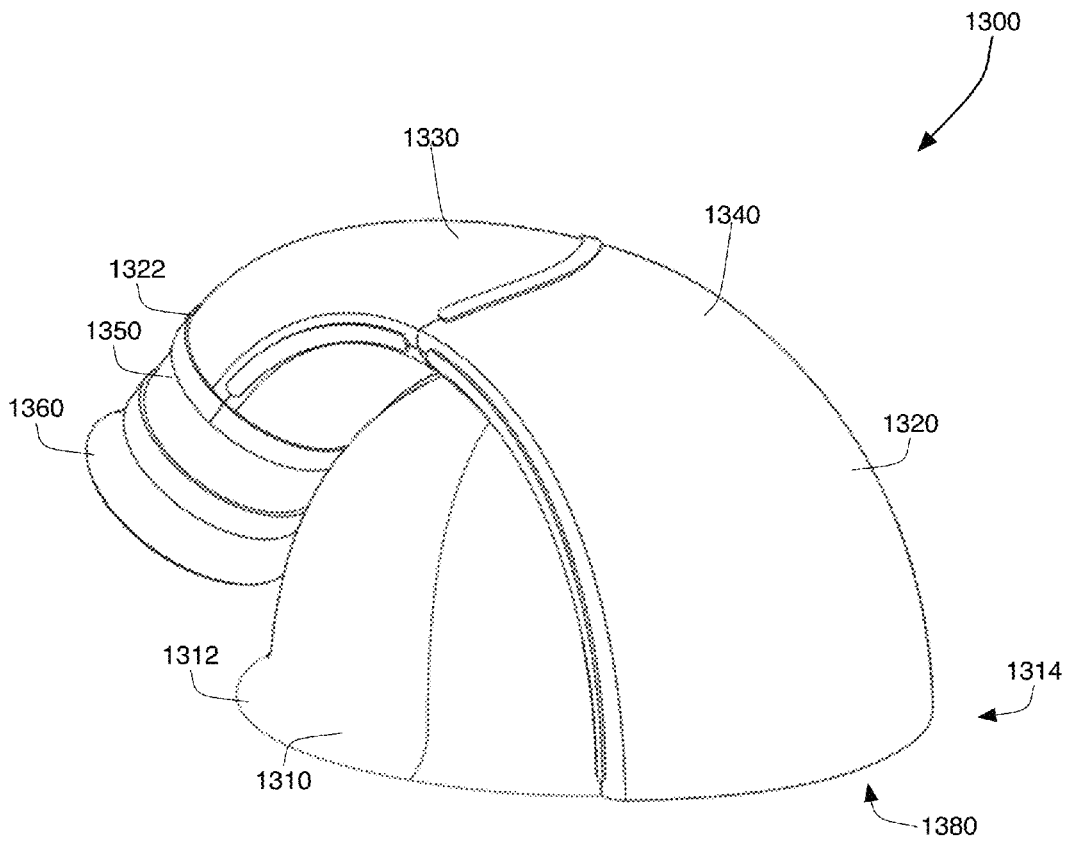
FIG. 13 is a an isometric view of a third embodiment of the invention

FIG. 13 shows a third embodiment of a hard hat or helmet 1300 incorporating the present invention. Once again, the helmet 1300 has a main body 1310 to house electrical and air-flow components. The helmet body 1310 is of the same construction as the helmet bodies 510, 110 described above and therefore provides protection against falling debris and impacts. The helmet 1300 also utilizes an adjustable helmet suspension system that can be clipped into the helmet 1300.

In helmet 1300, the air-flow components have been designed to maximize air flow by minimizing resistance within its air chambers. Helmet 1300 is designed with a single, large circular blower fan 1350 mounted on the rear end 1312 of the helmet body 1310. The blower fan 1350 pulls air through a circular filter or filter cartridge 1360. The filter 1360 can be of a similar construction as the filter/filter cartridge 540 described above, and can be attached using similar attachment mechanisms. After pulling the air through the filter 1360, the fan 1350 pushes the air through air-flow chamber 1320 over the top of the helmet body 1310. The filtered air then exits the air-flow chamber at the air curtain exit location 1380 located at the front 1314 of body 1310. The air-flow chamber 1320 may be constructed out of the same rugged material as the main helmet body 1310, therefore providing additional protection against impacts and falling objects.

Figure 14:
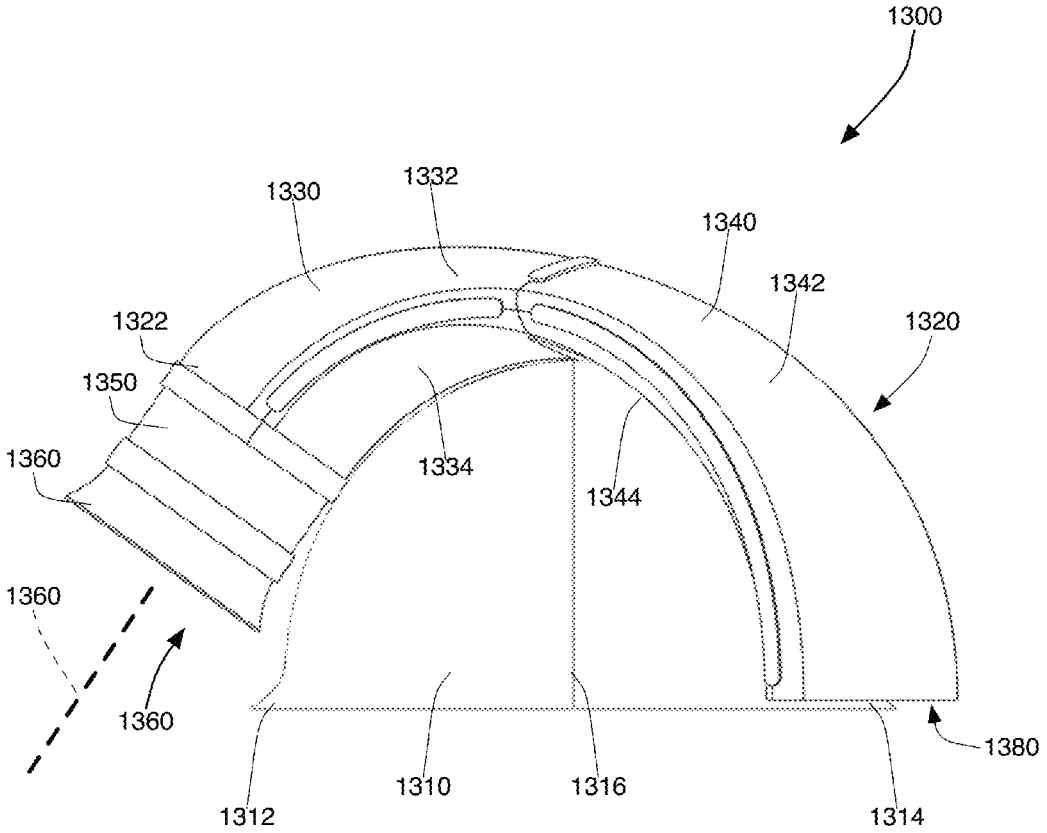
FIG. 14 is a side plan view of the third embodiment.
Figure 15:
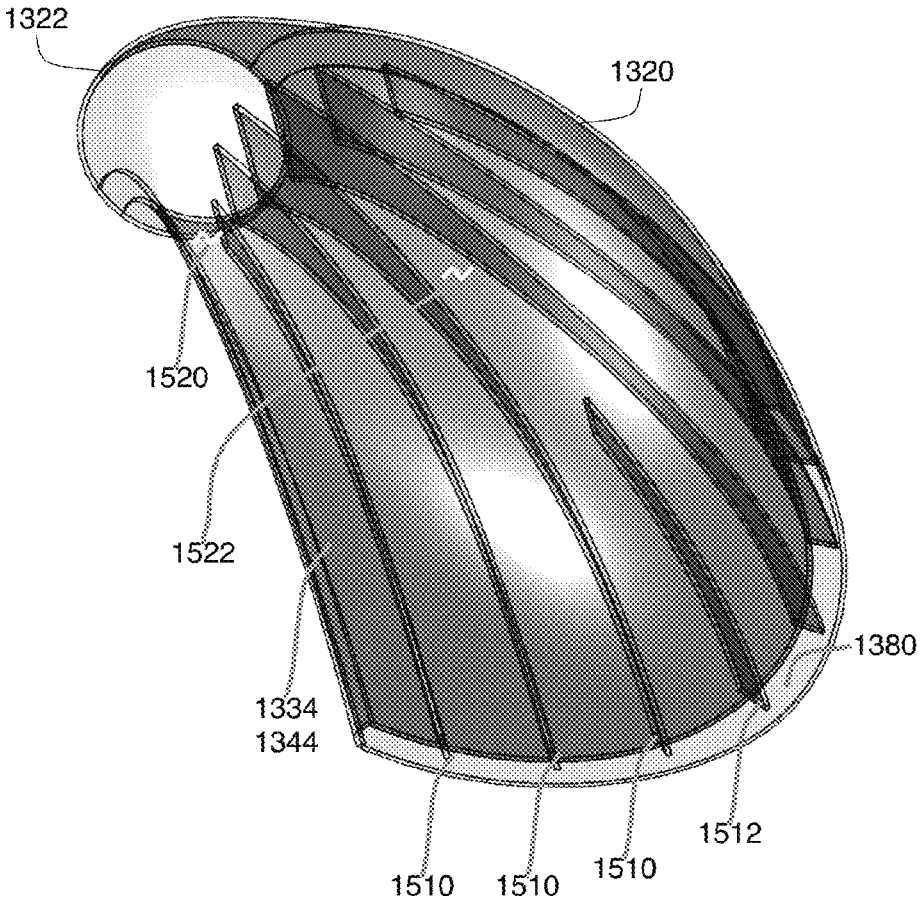
FIG. 15 is an isometric view of an air flow chamber used in the third embodiment, with a partially transparent outer wall revealing the interior of the air flow chamber.
Figure 16:
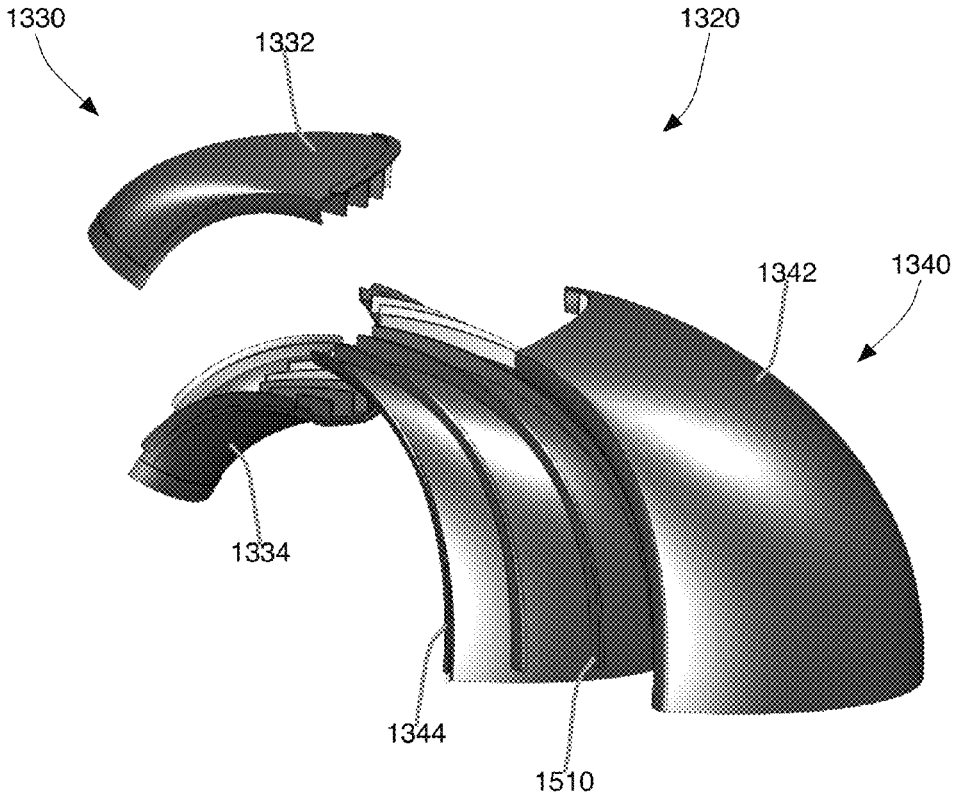
FIG. 16 is an exploded, isometric view of an air flow chamber that can be used in the third embodiment.

The construction of the air-flow chamber 1320 can be seen in greater detail in FIGS. 14, 15, and 16. In one embodiment, the air-flow chamber 1320 is constructed into two segments, a rear segment 1330 and a front segment 1340. The rear segment 1330 has an outer wall 1332 and an inner wall 1334. Similarly, the front segment 1340 of the air-flow chamber 1320 also has an outer wall 1342 and an inner wall 1344. These four walls 1332, 1334, 1342, 1344 are attached together to form the entire air-flow chamber 1320. This attachment can be permanent in nature, such as through gluing, epoxy, or heat welding. Alternatively, the attachment can be more temporary, allowing the different walls 1332, 1334, 1342, 1344 to be detached from each other by the user for cleaning. Once assembled, the air flow chamber 1320 is then attached to the circular fan 1350 and filter 1360 combination, and to the helmet body 1310 to form helmet 1300. In other embodiments, the air flow chamber 1320 is constructed as a single unit, such as through injection molding or 3D printing. In still other embodiments, the air flow chamber 1320 is constructed as a single element integrated with the helmet body 1310, effectively using the front of the helmet body 1310 as part of the inner walls 1334, 1344. It is even possible to create a fan housing and filter connector as part of this unitary element, requiring only the insertion of the fan and the attachment of the filter to complete the helmet 1300.

Although it is not shown in FIGS. 13-16, the helmet 1300 is also preferably operated using a battery pack attached to this helmet. This battery pack can be attached through a connecting boss, such as battery connecting boss 180 described above. The battery pack could also include an on-off switch and a fan speed switch/regulator as was described above. These control switches need not be mounted on the battery pack, but can be located anywhere on the helmet 1300 that would be easily accessible to the helmet wearer. In yet another embodiment, power for the fan 1350 comes from an external battery pack that would be carried on the waist or over the shoulder of the wearer. The on/off and fan speed controls could be found on this external battery pack, or could remain on the helmet itself. In one embodiment, the battery pack powers the blower fan 1350 at approximately 6.2 volts and 5 amps. In this embodiment, a standard axial fan 1350 having a diameter of 58 mm is able to achieve an average exit velocity at the air current exit 1380 of 37 mph, which was sufficient to create the desired air curtain. In the tested embodiment, the air curtain exit 1380 had a thickness that varied between 0.375 inches and 0.65 inches. In the preferred embodiment, the thickness of the slot that forms the air curtain exit 1380 can be anywhere between 0.2 inches and 0.65 inches.

The rear segment 1330 of the air-flow chamber 1320 connects to the fan 1350 through a circular interface or entrance 1322. The circular entrance 1322 to the air-flow chamber 1320 ensures that maximum airflow will be provided into the air-flow chamber 1320. The diameter of the circular entrance is preferably at least as large as the diameter of the fan blades in fan 1350. Furthermore, the circular blower fan contains a spinning fan blade that spins around an axis 1360 and that blows air parallel to this axis 1360. The circular entrance 1322 to the air-flow chamber 1320 is perpendicular to and centered around this axis 1360, which maximizes the air flow into the air-flow chamber 1320. In the preferred embodiment, the axis of rotation 1360 points generally upward along the back of the helmet body 1510, at an angle of approximately 40 to 65 degrees upward from level.

The overall shape of the air-flow chamber 1320 is designed to gently redirect the incoming air from fan 1350 around the head-shaped helmet body 1310 to the air curtain exit 1380 at the front 1314 of the body 1310. To accomplish this, the outer walls 1332 and 1342 of the air-flow chamber 1320 have a single, large curve or arc over the top of the helmet body 1310. The height of the air-flow chamber 1320 lessens as the air moves from the circular entrance 1322 (where the height is equal to the diameter of the entrance 1322) to the narrow air curtain exit 1380. This reduction in height along the path of air flow is best seen in FIG. 14. In contrast with this reducing height, the width of the air-flow chamber increases from the circular entrance 1322 (whether the width is equal to the diameter of the circular entrance 1322) to the air curtain exit 1380 (where the width extends around much of the front 1314 of the helmet body). This increasing width is best seen in FIG. 15. In some embodiments, the width of air curtain exit 1380 is even wider than that shown in the figures. It is possible to extend this width so that the exit 1380 extends half way around the helmet 1300 across the whole front 1314 of the helmet body 1310 (extending to the center line 1316 of the helmet body 1310 shown in FIG. 14). Even in the less wide embodiment shown in FIGS. 13-16, the air curtain exit 1380 of the air-flow chamber 1320 curves across the front 1314 of the helmet body 1310. This curve is best seen in FIG. 15.

The arrangement of this air-flow chamber 1320 contrasts greatly with the air flow in helmets 100 and 500 described above. In helmet 1300, air exits the fan axially (along the axis of rotation). In contrast, helmets 100 and 500 use a radial flow fan where air exits the fan in a radial direction relative to the shaft. In both helmets 100, 500, the air flow is restricted before reaching the air curtain exit 170, 700 respectively. In helmet 100, the air must flow through circular tubes 160 and then is forced to exit out a narrow slit 170 of a much different dimension than the tubes 160. In helmet 500, the air must flow from the side flow channels 550 into the main flow channel 560, through the connection nipples 562 and the air curtain tubing 570 before flowing out air curtain exit 530. In comparison to these embodiments 100, 500, the helmet 1300 starts with a circular entrance 1322 and the walls of the chamber 1320 reduce in height, expand in width, and curve over the head shape helmet body 1310 smoothly and without any sharp angles or abrupt wall edges. This greatly improves air flow through the helmet 1300 and therefore increases the amount of air that leaves the air curtain exit 1380 for a given fan capacity.

Because the width of the air-flow chamber 1320 expands as it moves from the circular entrance 1322 to the exit 1380, the preferred embodiment uses a series of fins 1510 to help evenly spread the air across with width of the exit 1380. These fins are shown most clearly in FIGS. 15 and 16. These fins 1510 start proximal to the circular entrance 1322 and extend from the inner walls 1334, 1344 to the outer walls 1332, 1342 of the chamber 1320. In this way the fins 1510 create a series of channels (such as channels 1520, 1522) to help direct the incoming air to a particular segment of the air curtain exit 1380.

Given the circular nature of the entrance, 1322, the center most channels (such as channel 1522) will receive greater air flow or pressure. To compensate for this, the channels created by the fins 1510 need not be uniformly spaced from entrance 1322 to exit 1380. In the preferred embodiment, the outer most channels (such as channel 1520) are given a relatively large proportion of the air at the entrance 1322. Otherwise these edge channels, which start at the edges of the circular entrance 1322, would receive insufficient air flow at the exit 1380. In FIG. 15, one can see that the edge channel 1520 has a relatively consistent width from the entrance 1322 to the exit 1380 of the air-flow chamber 1320. In contrast, the centermost channel 1522 starts at the entrance 1322 with a width similar to channel 1520 but ends at the exit 1380 with a width that is between 2-4 times wider (in other words, the ratio of ending width to starting width is greater for the centermost channel 1522 than it is for the outermost channels 1520). In fact, channel 1522 becomes wide enough that a partial fin 1512 is inserted into this channel 1522 to help keep the air flow at the exit 1380 consistent across this channel 1522.

Eyewear Protection System

The helmets 100, 500, 1300 described above are effective for keeping airborne particles from a user's face and eyes. In many cases, safety requires that protective eyewear be used at all time. The described embodiments 100, 500, 1300 are particularly effective when protective eyewear is used, as the air current created by these helmets 100, 500, 1300 greatly reduce the dirt and paint that contacts the eyewear.

Figure 17:
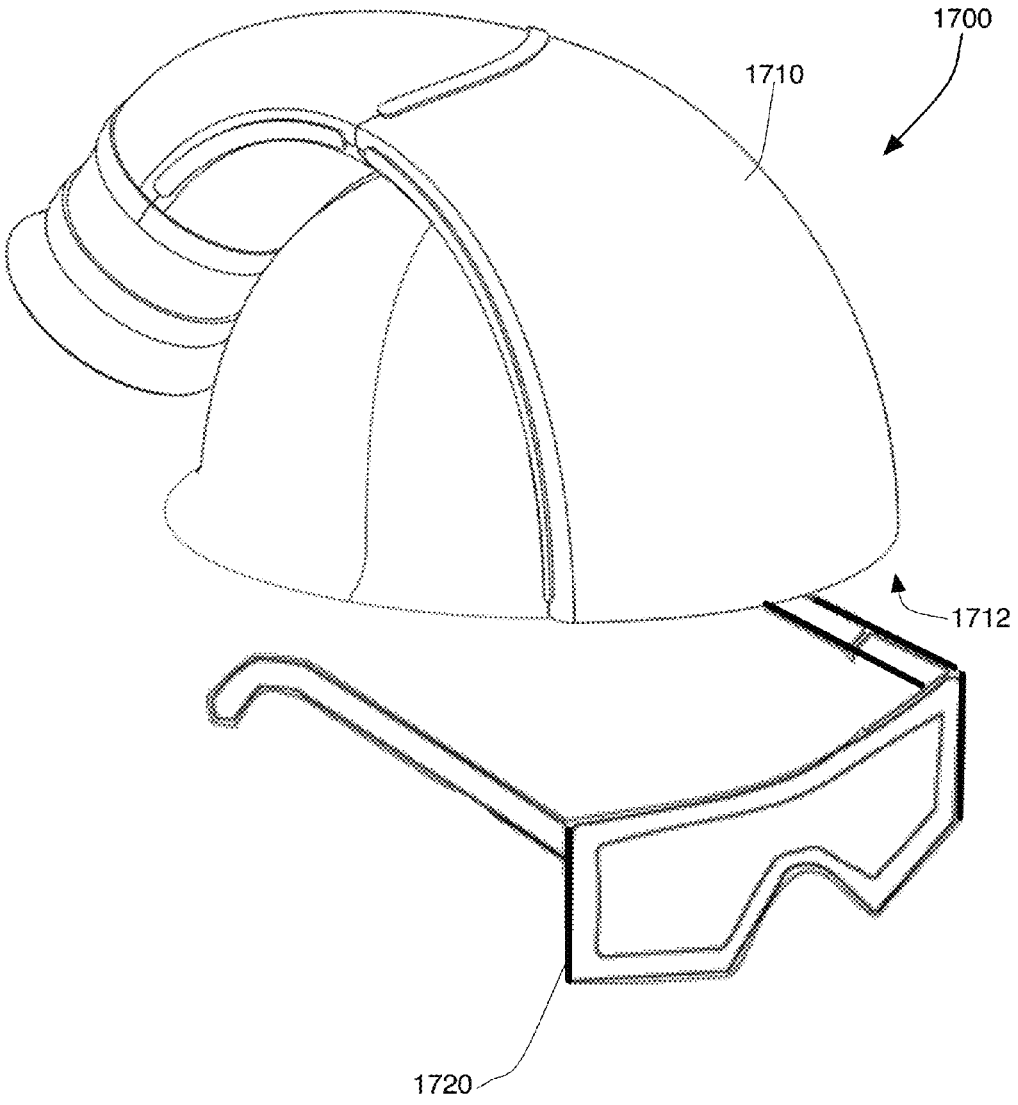
FIG. 17 is an isometric view of the third embodiment used in a first eyewear protection system.
Figure 18:
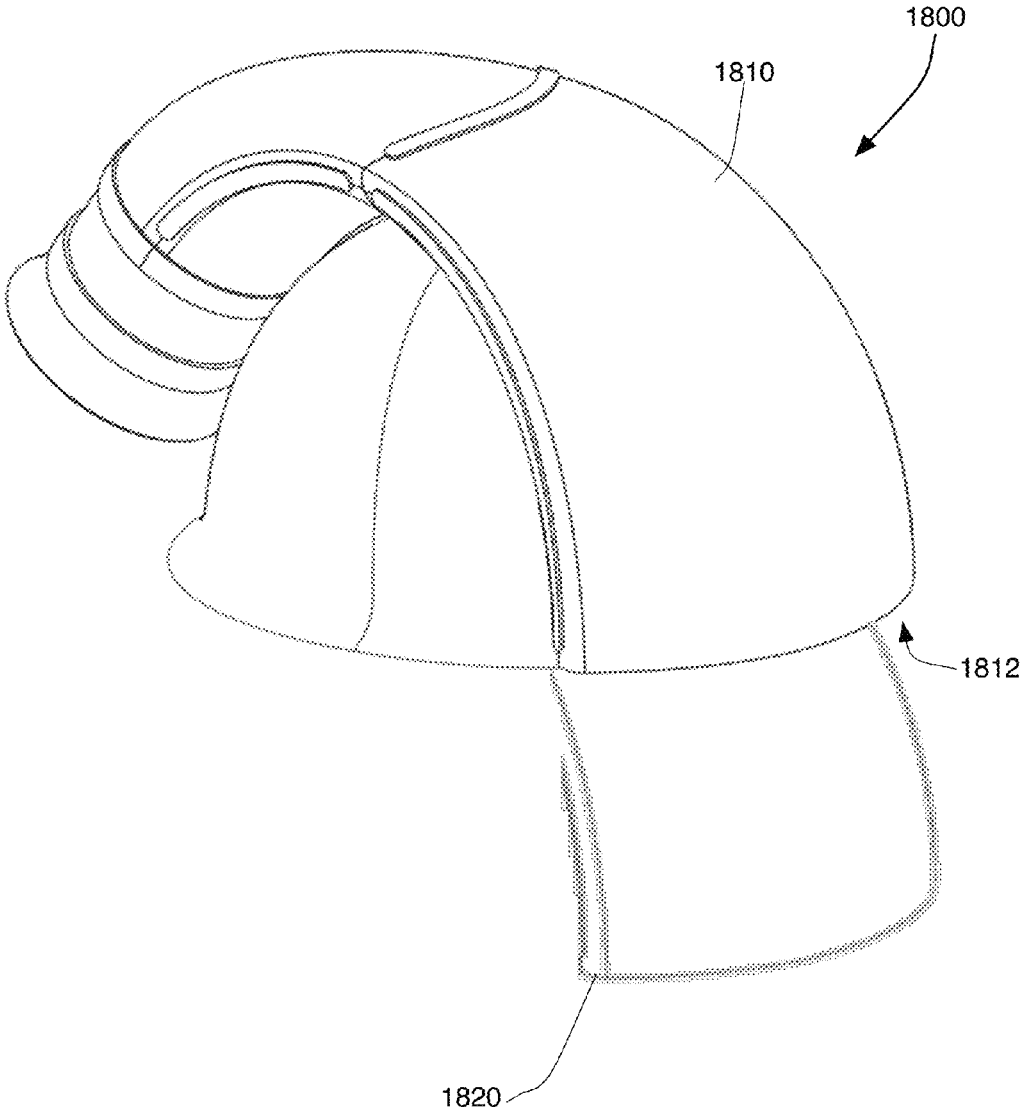
FIG. 18 is an isometric view of the third embodiment used in a second eyewear protection system.

FIG. 17 shows a system 1700 in which a helmet 1710 produces an airstream curtain through air curtain exit 1712. This air stream passes in front of a pair of goggles 1720 worn by the user of the helmet 1710, effectively creating an air curtain in front of the goggles 1720. The air curtain 1712 keeps the goggles free from dust, airborne paint, and other particulates. The goggles 1720 have a transparent lens or lenses made of a polycarbonate or other transparent plastic.

Similarly, Figure 1800 shows a helmet 1810 that also creates an air curtain by passing a stream of air through air curtain outlet 1812. In this case, the helmet 1810 includes an integrated, transparent plastic or polycarbonate face shield 1820. This face shield 1820 meets some safety requirements for eye protection. However, when used in dirty environments, this face shield would quickly become contaminated. Users would have to remove the helmet in order to satisfactorily clean the face shield 1820, which obviously increases the risk to any user that is not able to wear the helmet 1810 during such cleaning. As the air stream leaving air current outlet 1812 prevents dust, paint particles, and other particulates from impacting the face shield 1820, the face shield 1820 stays clean and the helmet 1810 will not need to be removed for cleaning.

The many features and advantages of the invention are apparent from the above description. Numerous modifications and variations will readily occur to those skilled in the art. Since such modifications are possible, the invention is not to be limited to the exact construction and operation illustrated and described. Rather, the present invention should be limited only by the following claims.

What is claimed is:

1. A helmet comprising:

a) a helmet body having a front and back side and a rounded top;

b) an air flow chamber;

c) the air flow chamber having:

i) a circular air flow entrance positioned at the back side of the helmet body;

ii) a main portion extending from the air flow entrance upward and over the rounded top of the helmet body; and iii) an air curtain exit at the front side of the helmet body;

wherein air passing through the main portion of the air flow chamber from the circular air flow entrance, exits the air flow chamber at the air curtain exit to form an air curtain extending downward from the front of the helmet.

2. The helmet of claim 1, further comprising a blower fan, the blower fan is in communication with the circular air flow entrance, the blower fan constructed and arranged to push the air through the air flow chamber in an axial direction.

3. The helmet of claim 2, further comprising an air filter, the blower fan configured to pull the air through the air filter before pushing the air through the air flow chamber.

4. The helmet of claim 2, further comprising a battery pack, the battery pack in communication with the blower fan.

5. The helmet of claim 2, wherein the air flow chamber is defined by walls, the walls extending along a curve of the helmet, the walls characterized by a reduction in height from the circular air flow entrance to curtain exit.

6. The helmet of claim 5, wherein the walls of the air flow chamber provide the air flow chamber with an increase in width as they extend from the circular air flow entrance to curtain exit.

7. The helmet of claim 6, further comprising a plurality of fins positioned between the walls of the air flow chamber, the plurality of fins dividing the air flow chamber into a plurality of air flow channels, at least some of the air flow channels extending from the circular air flow entrance to curtain exit.

8. The helmet of claim 2, wherein the air that exits the air flow chamber at the air curtain exit has an average exit velocity of 37 mph.

* * * * *